United States Patent [19]

Reichert et al.

[11] 4,378,805

[45] Apr. 5, 1983

[54] ONE PIECE BODICE GARMENT FOR MASTECTOMY PATIENT

[76] Inventors: D. Jeanie Reichert, W. 620 - 7th Ave., #104, Spokane, Wash. 99204; Carol S. Trottier, N. 320 Blake Rd., Spokane, Wash. 99216; Cathy Y. Calhoon, N. 904 Wilbur Rd., Spokane, Wash. 99206

[21] Appl. No.: 336,552

[22] Filed: Jan. 4, 1982

[51] Int. Cl.[3] ..... A41C 1/06

[52] U.S. Cl. ..... 128/450; 128/455

[58] Field of Search ..... 128/450, 452, 425, 454, 128/455

[56] References Cited

U.S. PATENT DOCUMENTS 3,297,035 1/1967 Wright ..... 128/455

3,746,007 7/1973 Hand et al. ..... 128/455

*Primary Examiner*—Doris L. Troutman

*Attorney, Agent, or Firm*—Wells, St. John & Roberts

[57] ABSTRACT

A one piece bodice garment for mastectomy patients is described having an inner garment panel 20 with an outer garment layer 74 superimposed thereover. The inner garment panel 20 includes a breast cup structure 22 having breast cups for receiving a breast and/or a breast prosthesis. The garment includes shoulder straps that extend from the upper corners of the breast cup structures upward and over the patient's shoulders and attaching to back sections 28 and 30 of the inner garment panel 20. Waist strap members 56 and 58 are connected to the lower corners of the breast cup structure and extend downward and around to the back of the patient. A neckline tension strap is mounted at the neckline supporting the inner garment panel 20 and the outer garment layer 74 between the shoulder straps to hold the front neckline close to the patient's chest. The outer garment panel 20 is connected to the inner garment layer at the neckline and is draped downward over the inner garment panel 20.

10 Claims, 8 Drawing Figures

ONE PIECE BODICE GARMENT FOR MASTECTOMY PATIENT

BACKGROUND OF THE INVENTION

A mastectomy operation normally leaves a mastectomy patient partially and significantly disfigured. Prosthesis devices have been devised to artifically replace the removed breast tissue to assist mastectomy patients to project a normal figure similar to the patient's figure prior to the operation. Frequently the prosthesis devices are heavier than the normal breast tissue and cannot be physically attached to the human flesh and consequently "float" much more so than the normal breast tissue. This is particularly disconcerting to the mastectomy patient who is quite active and desires to participate in normal activities which include body movement and arm movement which engenders the displacement of the breast tissue. The prosthesis device is much more likely to assume an unnatural position more readily than the normal breast tissue causing mastectomy patients psychological embarrassment and emotional trauma.

In the past mastectomy patients have been restricted greatly in the variety of upper garments such as blouses and dresses, that will accommodate a breast prosthesis and which will not overly restrict the patient's activities and movements.

This invention provides a unique one piece bodice garment for mastectomy patients which greatly increases the garment styles which may be utilized by the patient. The garment enables the patient to wear more feminine and a wider variety of dress and blouse styles without the adverse emotional insecurity and apprehension.

BRIEF DESCRIPTION OF THE DRAWINGS

A preferred and alternate embodiment of this invention is illustrated in the accompanying drawings, in which.

DETAILED DESCRIPTION OF PREFERRED AND ALTERNATE EMBODIMENTS

Figure 1:
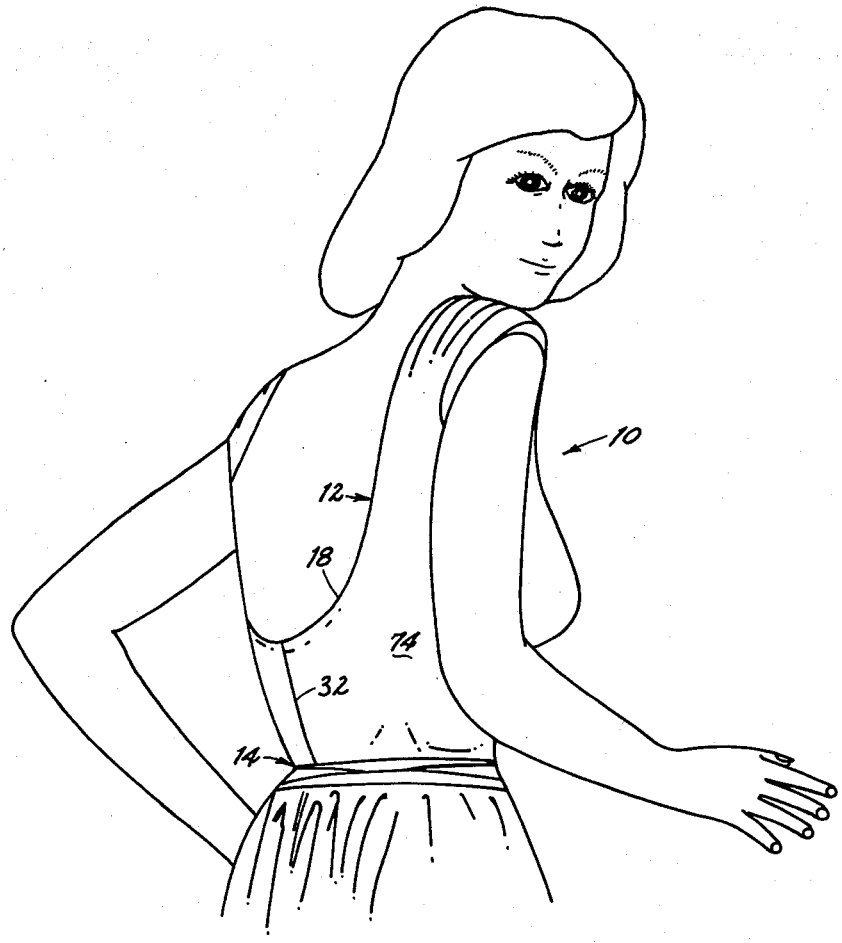
FIG. 1 is an isometric view of a mastectomy patient wearing the one piece bodice garment which is the subject of this invention.

The following disclosure is submitted in accordance with the constitutional purpose of the patent laws to: "promote the progress of science and useful arts" (Article I, Section 8).

A one piece bodice garment is generally designated with the numeral 10. The bodice garment 10 may be in the form of a blouse or may be an upper portion of a dress or similar type garment. For purpose of this invention, the bodice garment 10 extends from a neckline 12 to near a waistline 14. In a "dress" configuration, the garment would extend even further down from the waistline over the woman's body. In most "blouse" configurations, the garment 10 would terminate near the waistline 14.

The neckline 12 includes a front neckline section 16 that extends across the patient's chest to the top of the shoulders and a back neckline 18 that extends from the top of the shoulders across the back of the patient. The neckline encircles the patient's neck and forms the uppermost portion of the garment.

One of the important components of the garment 10 is an inner garment panel 20 that extends from the neckline 12 to the waistline 14. The inner garment panel 20 is intended to generally contact the patient's skin, however, some patients may desire to wear an undergarment between the patient's skin and the inner garment panel 20. The inner garment panel 20 includes a breast cup structure 22 (FIGS. 2 and 3) that is designed to simulate a bra to complement the natural breast structure or figure of the patient. Some patients may have a single mastectomy in which only one of the breasts is partially or totally removed while in other cases the patient may have experienced a double mastectomy in which both breasts were removed. In either event, the breast cup structure 22 is designed to accommodate either a single or double mastectomy and to enable the patient to project a natural breast profile while wearing the garment 10.

The inner garment panel 20 includes an upper section 24 that is sewn to, otherwise connected to or formed integrally with the breast cup structure 22 and extends upward over the patient's chest to the front neckline 16. The inner garment panel 20 includes a lower section 26 that is sewn to, or otherwise connected to, or formed integrally with the breast cup structure 22 and extends downward from the breast cup structure over the patient's abdomen to the waistline 14.

The inner garment panel 20 further includes back sections 28 and 30 that are formed integrally or otherwise connected to or sewn to the breast cup structure and other sections for extending behind the patient. The back sections 28 and 30 are connected to a fastening means 32 (FIG. 3) for interconnecting the sections 28, 30 of the inner garment panel 20 to fully encompass the upper torso of the patient. Preferably, the fastening means 32 includes a zipper that can quickly and efficiently enable the patient to put on or take off the bodice garment with a minimum of effort.

Figure 4:
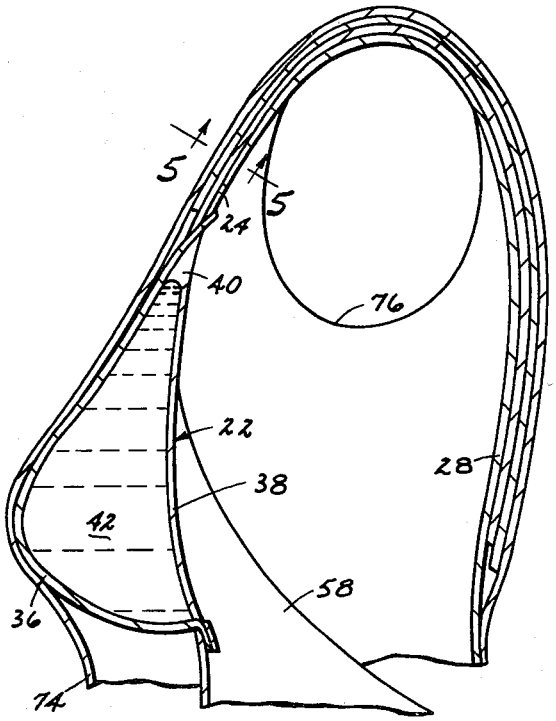
FIG. 4 is a cross-sectional view of the garment taken along line 4—4 in FIG. 2 to illustrate the location of the breast prosthesis in relationship to various components of the bodice garment and the patient's body.

The breast cup structure 22 preferably includes two breast cups 34 and 36 that are constructed substantially identical and are positioned within the structure 22 corresponding to the natural location of the patient's breast prior to the operation. The breast cups 34 and 36 may be made of traditional materials that are used for standard bras. Depending upon whether or not the patient has had a single mastectomy or a double mastectomy depends upon whether or not the breast cup 34 or 36 or both will be more specifically designed to securely hold a breast prosthesis 42. In the illustrated embodiment, breast cup 36 contains the breast prosthesis 42. To secure the breast prosthesis in the breast cup 36, an enclosure wall 38 is formed over the breast cup 36. The enclosed wall 38 includes an opening 40 (FIGS. 1, 2 and 4) to enable the patient to easily insert the breast prosthesis 42 and to remove the breast prosthesis for use in other garments or when the garment is being cleaned. It should be understood that although many breast prosthesis are designed to simulate the weight of the human flesh, the breast prosthesis is not physically attached to the skin. Consequently, the breast prosthesis provides a substantial, normally unattached weight that may be easily accelerated upward or downward or moved out of position through movement of the body which does not simulate natural movement of a natural breast. It is very important that the garment 10 provide appropriate structure to accommodate and to restrain any unnatural movement of the breast prosthesis 42.

In accomplishing this purpose, the garment 10 further includes shoulder strap members 44 and 46 that are operatively connected to the breat cup structure 22 and extend upward and outward over corresponding shoulders and then downward along respective back sections 28, 30. Specifically, each shoulder strap member 44 includes one end 48 that is either sewn to or otherwise fastened to breast cup structure 22 near the upper and outer portion of the structure. Each strap member 44, 46 then extends upward and over one of the shoulders terminating in an end 50. The end 50 is sewn to or otherwise secured to a respective back section 28, 30 to apply upward and outward tension on the breast cup structure to assist in securing the breast cup structure to the patient's body. One of the straps 44, 46 may be somewhat shorter than the other, depending upon whether or not there has been a single or double mastectomy. It has been found advantageous to utilize a shortened shoulder strap member 44, 46 on the side that has the breast prosthesis. In the example shown, the strap 46 is slightly shorter than the strap 44 to provide somewhat greater tension over the corresponding shoulder.

Figure 5:
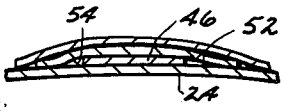
FIG. 5 is a cross-sectional view of a shoulder strap portion of the bodice garment as taken along line 5—5 in FIG. 4.

In a preferred embodiment, each of the shoulder strap members 44, 46 are channelized in a lining 52 (FIG. 5) that is sewn to the inner garment panel 20 as the strap extends from the breast cup structure 22 over the shoulder and down for connection to the back sections 28, 30. The lining 52 is designed to prevent lateral movement of the straps but to permit the straps to move longitudinally or to be adjusted longitudinally within a channel 54 formed between the lining 52 and the upper section 24 and the back sections 28 and 30. It is desirable to prevent the lateral movement of the strap members 44 and 46 with respect to the inner garment panel 20.

Figure 2:
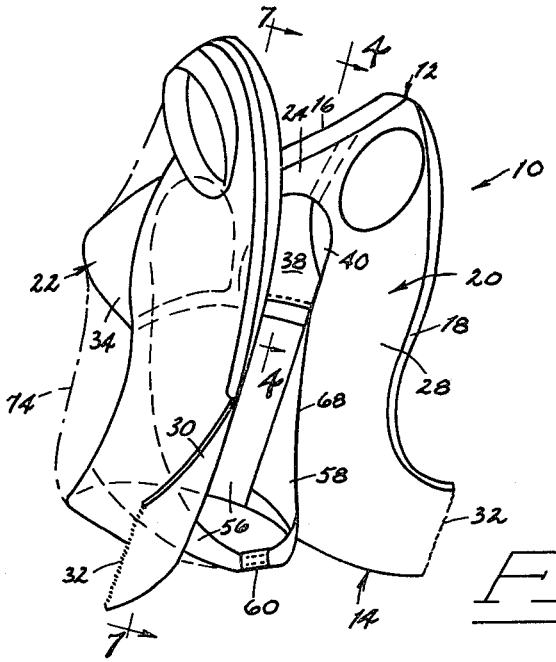
FIG. 2 is an isometric view of the bodice garment with a portion of the garment opened to view portions of the interior.
Figure 3:
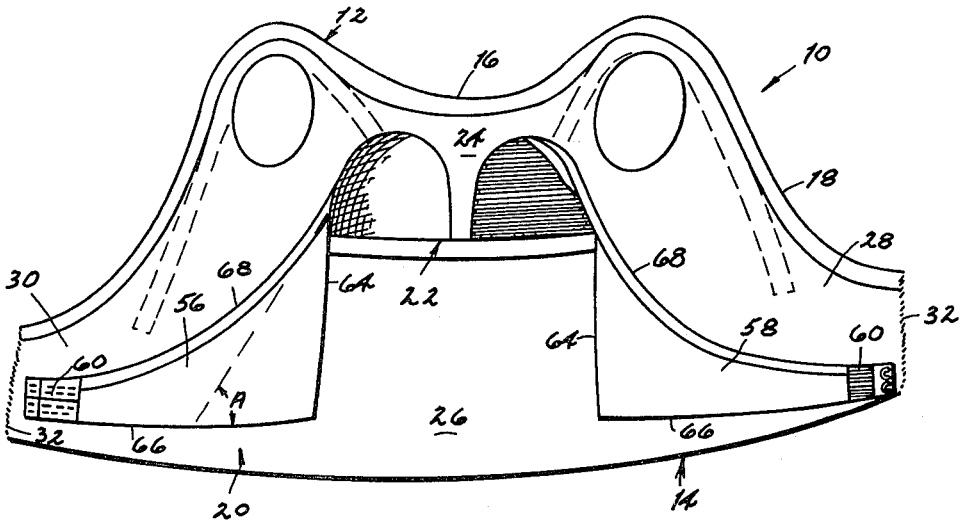
FIG. 3 is a rear view of the bodice garment as the bodice garment is laid out in an extended plane condition.

The garment 10 further includes waist strap members 56 and 58 that are operatively connected to the breast cup structure 22 and extend around the back of the patient. Each of the waist strap members 56, 58 have a complementary connecting end 60 for interconnecting the waist strap members 56 and 58 to additionally secure the breast cup structure 22 to the body. The waist strap members 56 and 58 extend downward and rearward from the breast cup structure 22 to apply lateral and downward tension on the breast cup structure that is complementary to the tension placed upon the breast cup structure from the shoulder strap members 44 and 46 to secure the breast cup structure 22 firmly to the mastectomy patient. More specifically, as illustrated in FIGS. 2 and 3, each of the waist strap members 56, 58 is triangularly shaped and includes a connecting vertical edge 64 that is sewn or otherwise connected to the breast cup structure 22 along the side of the breast cup structure for applying downward and lateral tension to the breast cup structure. In a preferred embodiment, the edge 64 is additionally similarly connected to the lower abdomen section 26. The vertical edge 64 extends downward alongside the breast cup structure and the lower section 26 terminating at a lower edge 66 adjacent the waistline 14. A lower edge 66 extends in a substantially horizontal orientation outward from the breast cup structure to the connecting end 60. The triangular shape waist strap members 56, 58 have a hypotenuse or upper edge 68 that extends downward and outward from the breast cup structure 22 in a somewhat curved arc to the connecting end 60. The upper edge 68 extends from the breast cup structure downward alongside of the patient and along the back of the patient terminating adjacent the waistline 14. The upper edge 16 extends downward at an initial angle "A" of between 50° and 75° with respect to the horizontal as indicated in FIG. 3.

In a preferred embodiment, the waist strap members 56 and 58 are made of a substantially nonstretchable material such as cotton so as to provide a rather uniform tension that will not change with continued use of the garment. The connecting end 60 may have a stretchable section to enable the patient to be able to interconnect the waist strap members 56, 58 with ease. Preferably, the waist strap members 56 and 58 are sewn or connected to the underside of the inner garment panel 60 so that the waist strap members 56, 58 would normally contact the patient's skin or undergarment.

The one piece bodice garment 10 further includes an outer garment layer 74 that extends over the inner garment panel 20. The outer garment layer 64 extends from the neckline 12 to the waistline 14 substantially superimposed over the inner garment panel 20. The outer garment layer 64 is draped over the inner garment panel 20 and is not attached to the inner garment panel 20 except along the neckline 12, arm apertures 76 and in some configurations along the fastening means 32. Otherwise, the outer garment as illustrated in FIGS. 2, 4, 6 and 7 merely drapes over the breast cup structure 22 in a very normal orientation appearing as a conventional garment (dress or blouse).

Figure 7:
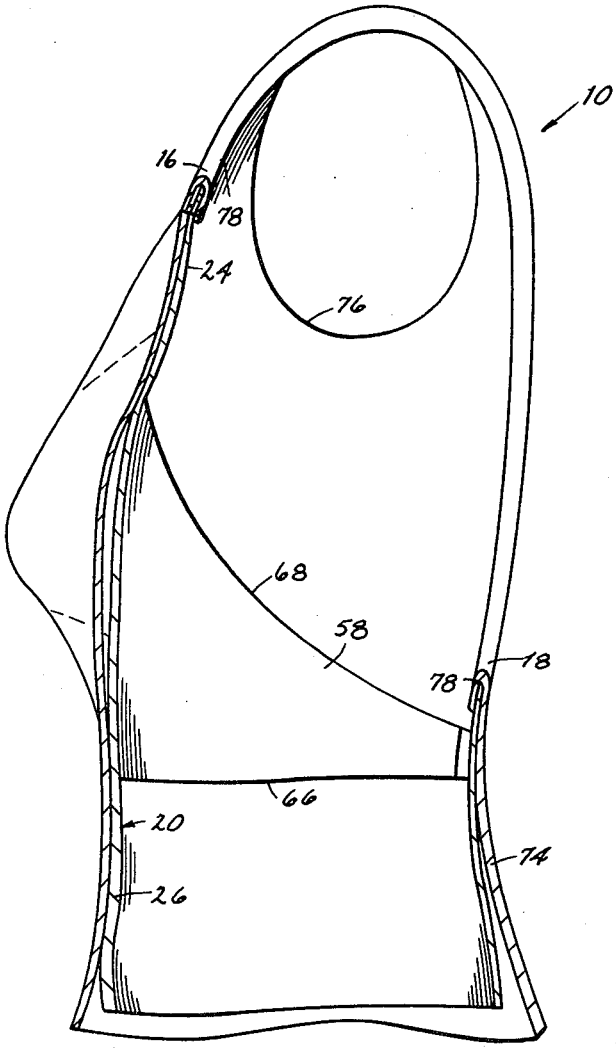
FIG. 7 is a vertical cross-sectional view of the garment similar to FIG. 4 except showing the garment in cross section taken along line 7—7 of FIG. 2.
Figure 8:
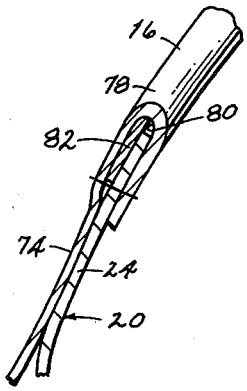
FIG. 8 is an enlarged cross-sectional view of the front neckline of the garment.

In a preferred embodiment, the outer garment has a neckline fold 78 that is illustrated in detail in FIGS. 7 and 8 for connecting to the upper section 24 and back sections 28, 30 of the inner garment panel 30. The fold is made to form a neckline channel 80 (FIG. 8) therein that receives a front neckline tension strap 82.

The front neckline tension strap 82 is slidably mounted within the channel 80 and is operatively interconnected to the shoulder strap members 44 and 46 to apply a tension on the upper section 24 of the inner garment 20 to secure or press the front neckline 16 to the patient's chest and to cause the upper section 24 to apply a lateral and upward tension on the breast cup structure 22. This additionally helps secure the breast cup structure 22 firmly to the patient's body. Depending upon the style of the garment, the front neckline tension strap 82 may extend along the front neckline 16 and interconnect to the shoulder strap members 44 and 46 at the shoulder's location. In other configurations, the front neckline tension strap 82 may extend in the channel 80 the full distance of the front neckline 16 and the back neckline 18 with ends of the front neckline tension strap 82 secured to the fastening means 32 to provide support along the entire neckline. In any event, the neckline tension strap 82 may be considered as operatively interconnected between the shoulder strap members 44 and 46 to provide upward tension on the upper sections 24 of the inner garment panel.

Consequently, the front neckline tension strap 82, and the shoulder strap members 44 and 46 provide upward and lateral tension to the breast cup structure 22 that is complementary to and opposing tension provided by the waist strap members 56 and 58 that provide a downward and lateral tension to the breast cup structure 22. The precise amount of tension may be adjusted depending upon which breast cup 34, 36 contains the breast prosthesis 42 to provide a balanced tension system.

Figure 6:
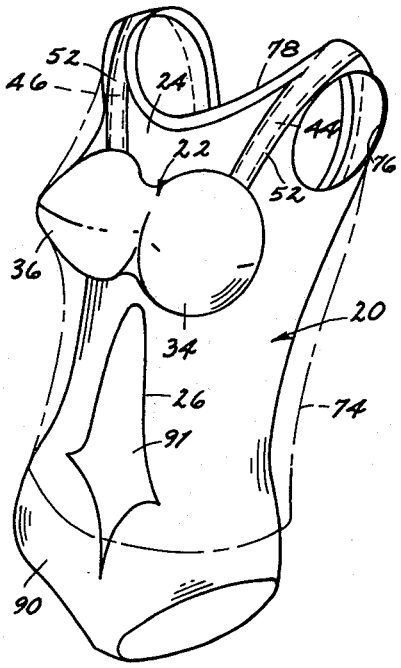
FIG. 6 is an isometric view of an alternate embodiment of the bodice garment in which an outer layer of the garment is illustrated in dotted line with the inner garment portion of the garment illustrated in solid line.

In an alternate embodiment, it may be necessary for larger women that require dresses in the sizes of sixteen and above, to provide an additional downward tension structure on the breast cup structure 22. Consequently, in an alternate embodiment, a crotch section 90 as illustrated in FIG. 6 may be provided that extends down between the patient's legs and is operably interconnected between the lower section 26 and the back sections 28 and 30 to additionally provide downward tension on the breast cup structure 22 to complement the upper tension applied by the shoulder strap members 44 and 46 and the front neckline tension strap 82. In several embodiments, it may be desirable to place a reenforcing layer or member 91 over the lower section 26 and crotch section 90 to minimize stretching of the crotch section fabric.

The applicant's one piece bodice garment 10 provides a very natural look that may accommodate fashionable feminine designs that greatly enhance the variety of the patient's wardrobe. As illustrated in FIGS. 1, 2 and 7, the applicant's one piece bodice garment can provide a "backless" gown or blouse type style that is very feminine and fashionable even though the patient is carrying a breast prosthesis 42. You will note in FIGS. 1, 2 and 7 that the back neckline 18 dips downward below the breast line of the patient suggesting that the garment has a minimum of breast support structure. Such a feature enables the patient to dress quite stylish including providing a variety of cocktail type dress configurations enabling the patient to attend many social functions that she might otherwise feel insecure or uncomfortable attending. The one piece bodice garment firmly secures the prosthesis in place while providing a very natural looking exterior without indicating any figure loss because of the mastectomy operation. The outer layer 74 drapes very naturally over the breast cup structure 22 while the inner garment panel 20 firmly secures the breast prosthesis to the patient so that the patient may feel comfortable in normal body movements including dancing and the like. The applicant's invention enables the mastectomy patient to feel comfortable at social events including parties. This provides a substantial psychological uplift to a mastectomy patient.

The above description of a preferred and alternate embodiment of this invention has been presented for purposes of illustration and example. It is not intended to have been exhaustive nor to limit the invention to the precise forms disclosed or described. It is intended that the scope of the applicant's invention be defined by the following claims.

We claim:

1. A one piece bodice garment for mastectomy patients, comprising:

an inner garment panel extending between a neckline and a waistline;

said inner garment panel having an intermediate front breast cup structure in which the structure has at least one breast cup adapted to receive a breast prosthesis;

said inner garment panel having an upper panel extending between the breast cup structure and the neckline for engaging the patient's chest;

said inner garment panel having a lower section extending between the breast cup structure and the waistline for engaging the patient's abdomen;

said inner garment panel having back sections adapted to extend to the back of the patient to engage the patient's lower back with the back sections having means for being interconnected to enable the inner garment panel to snugly encircle the patient;

shoulder strap members having one end operatively connected to the breast cup structure and an opposite end operatively connected to a respective back section of the inner garment panel and adapted to extend over the shoulders of the patient to provide upward-lateral support of the breast cup structure to secure the breast cup structure firmly to the patient's body;

waist strap members having one end operatively connected to the breast cup structure and an opposite interconnecting end which is adapted to extend downward from the breast cup structure and around the patient's waist to provide downward-lateral support to the breast cup structure to secure the breast cup structure firmly to the body;

an outer garment layer affixed to the inner garment layer along the neckline and draped downward over the under garment panel to the waistline; and a front neckline tension strap operatively interconnecting the shoulder straps and supporting the upper section of the inner garment panel and the outer garment panel along the neckline to maintain a front portion of the neckline of the inner garment panel and the outer garment layer taut and to provide upward support to the breast cup structure intermediate the shoulder strap members.

2. One piece bodice garment of claim 1 wherein the shoulder straps are mounted in channels formed in the upper section and the back sections of the inner garment panel to minimize lateral movement of the straps relative to the inner garment panel.

3. The one piece bodice garment of claim 1 wherein the front neckline includes a channel for receiving the front neckline tension strap to enable the front neckline tension strap to slide within the channel relative to the outer garment layer to maintain the outer garment layer snug to the chest without disturbing the outer garment layer along the neckline.

4. The one piece bodice garment of claim 1 wherein the waist straps are additionally operatively connected to the lower section of the inner garment panel to stretch the front lower section firmly against the patient's abdomen to more firmly secure the breast cup structure to the patient's body.

5. The one piece bodice garment of claim 1 wherein the waist strap members are operatively interconnected to the under side of the inner garment panel along sides of the dress cup structure for extending around the patient's waist beneath the inner garment panel.

6. The one piece bodice garment of claim 1 wherein the waist strap members initially extend downward from the breast cup structure at an angle of between 50° and 70° with respect to horizontal.

7. The one piece bodice garment of claim 1 wherein the waist strap members are triangularly shaped having (1) a substantially vertical edge secured to the breast cup structure and the lower section, (2) a substantially horizontal edge extending outward from the lower section for encircling about the waist; and (3) a hypotenuse edge extending downward and outward from the breast cup structure for passing downward across the side and back of the patient.

8. The one piece bodice garment of claim 1 wherein the lower section is formed of a material that is substantially nonstretchable in the horizontal direction.

9. The one piece bodice garment of claim 1 wherein the inner garment panel further include a crotch section extending downward from the lower section interconnecting with the back panels between the patient's legs.

10. The one piece bodice garment of claim 1 wherein the back neckline extends downward elevationally below the breast cup structure.

* * * * *